US008733216B1

(12) United States Patent
Cantlon

(10) Patent No.: US 8,733,216 B1
(45) Date of Patent: May 27, 2014

(54) DEPTH SETTER BIT HOLDER

(75) Inventor: Nathan C. Cantlon, Charlo, MT (US)

(73) Assignee: Jore Corporation, Ronan, MT (US)

( * ) Notice: Subject to any disclaimer, the term of this patent is extended or adjusted under 35 U.S.C. 154(b) by 306 days.

(21) Appl. No.: 12/831,077

(22) Filed: Jul. 6, 2010

(51) Int. Cl.
*B25B 23/12* (2006.01)

(52) U.S. Cl.
USPC ..... 81/439; 81/451; 81/429

(58) Field of Classification Search
USPC ..... 81/436–439, 451, 429, 125
See application file for complete search history.

(56) References Cited

U.S. PATENT DOCUMENTS

| | | | | |
|---|---|---|---|---|
| 5,724,873 | A * | 3/1998 | Hillinger | 81/451 |
| 6,154,108 | A * | 11/2000 | Huang | 81/125 |
| 6,931,967 | B1 * | 8/2005 | Chang | 81/451 |
| 7,210,382 | B2 * | 5/2007 | McCracken | 81/429 |
| 7,261,023 | B2 * | 8/2007 | Taguchi | 81/451 |
| 7,669,860 | B2 * | 3/2010 | Chiang | 279/143 |

* cited by examiner

*Primary Examiner* — Hadi Shakeri
(74) *Attorney, Agent, or Firm* — Christensen O'Connor Johnson Kindness PLLC

(57) ABSTRACT

A depth setter bit holder formed in accordance with the present disclosure includes a main bit holder body having a first receptacle, a drive bit removably receivable within the first receptacle of the main bit holder, and a depth setter body removably securable on the main bit holder body such that the depth setter body partially encloses the drive bit.

20 Claims, 5 Drawing Sheets

DEPTH SETTER BIT HOLDER

BACKGROUND

Modern construction practices assemble wall and ceiling surfaces by using manufactured panels that are placed adjacent to one another and affixed to the structural "studs" of the building. These manufactured panels, generally referred to as "drywall," are available from several manufactures in stock sizes. Drywall panels are configured as a filler/structural material sandwiched between two outer surface layers of paper. The structural integrity of the drywall panel relies on the bond between this paper and the internal filler material.

The drywall panels are typically attached to the building studs with drywall screws. Drywall screws typically have a tapered countersink head with a flat face. The drywall screw is installed through the drywall panel and into the stud of the building. The drywall screw is installed in the drywall so that the head of the screw is at least below the outer surface of the drywall. In this manner, the drywall panel can be coated with joint compound, drywall mud, etc. to aesthetically finish the drywall without the screw head protruding therefrom.

The drywall panel is secured to the stud by the interference of the screw head pulling the panel against the underlying stud. If the installer uses too much pressure and sets the drywall screw head too deep into the drywall panel, the outer paper layers and underlying filler layers can be damaged. Thus, it is important that the drywall screws be installed within the panel at a proper depth.

To install the drywall screws at a proper depth, there are several commercially available options for installers. There are task specific power tools, such as drywall electric screw guns or drywall screwdrivers, which have adjustable depth and clutching features to set the drywall screw at a desired depth within the drywall panel. The draw back is that these power tools are only useful for this particular job. The cost and limited use of these tools makes them impractical for users who are not professional drywall installers.

There are also simple driver bits that can be used with a standard hand drill.

These are typically referred to as "depth setter bits," "screw indenters," "dimpler bits," etc (hereinafter collectively referred to as "depth setter bits"). An example of a prior art depth setter bit is shown in FIG. 4. Depth setter bits are a permanent assembly of two components. Specifically, depth setter bits include a ring R that is permanently affixed to an insert bit B (such as a one inch, Phillips bit) at a preset position. The ring R acts as a depth stop for the bit B when the bit is driving a screw within a drywall panel. More specifically, with the ring R engaging the drywall panel, further driving action by the installer results in the bit tip disengaging the screw head as the screw is driven to its finished depth in the drywall.

The prior art depth setter bit is a simple and effective installation tool, but it has some inherent drawbacks. The stop ring R makes the bit B more expensive and limits its use to the specific task of installing drywall panels. It is known in the art that the stop limit and disengagement caused by the ring R accelerates wear to the bit driver tip and therefore requires frequent replacement. Since these specialty depth setter bits are more expensive and harder to obtain than standard drive bits, the cost often outweighs the benefits of using a depth setter bit.

In addition, with the ring R being permanently attached to the bit B, the depth setter bit cannot be used in edge or corner installations. More specifically, the drive bit tip cannot sufficiently extend into the drywall panel due to the interference of the stop ring R with the drywall corner. In these situations, the ring R can cause the bit B to disengage the screw head prematurely, thereby leaving the screw head exposed above the drywall surface. In order to properly install the drywall screws in a corner, the entire depth setter bit must be removed from the chuck or receptacle of the hand tool and replaced with a standard bit, which is time consuming and inefficient.

Furthermore, the ring R and bit B combinations are used in conjunction with industry standard magnetic bit holders H that add length to the bit B for ease of use. The magnetic bit holders H have receptacles that magnetically retain the end of the bit B therein. The bit holders H also increase the magnetism of the bit B to help hold the driven screw in place on the bit end during installation. The depth setter bit rings R are generally produced from steel so that they may be press fit onto the bit B. The magnetic properties of these steel rings R diminish the magnetic force of the bit holder H and the bit B. In most bit holders H, magnetic force is typically all that is used to secure the bit within the holder. If the tip of the bit B sticks in the screw head, the pulling force being exerted on the bit B can easily overpower the holding force of the magnet, and the bit B can become dislodged from the bit holder H.

Based on the foregoing, it can be appreciated that a low-cost depth setter bit having improved magnetic properties and versatility is desired.

SUMMARY

A depth setter bit holder formed in accordance with the present disclosure includes a main bit holder body having a first receptacle, a drive bit removably receivable within the first receptacle of the main bit holder, and a depth setter body removably securable on the main bit holder body such that the depth setter body partially encloses the drive bit.

A depth setter bit holder for use with a hand tool formed in accordance with another aspect of the present disclosure includes a main bit holder body having a first receptacle, a drive bit removably receivable within the first receptacle of the main bit holder body, an attachment shank extending from the main bit holder body opposite the drive bit, a depth setter body removably securable on the main bit holder body such that the depth setter body partially encloses the drive bit, and a locking mechanism configured to releasably secure the depth setter body to the main bit holder body.

This summary is provided to introduce a selection of concepts in a simplified form that are further described below in the Detailed Description. This summary is not intended to identify key features of the claimed subject matter, nor is it intended to be used as an aid in determining the scope of the claimed subject matter.

DESCRIPTION OF THE DRAWINGS

The foregoing aspects and many of the attendant advantages of the present disclosure will become more readily appreciated by reference to the following detailed description, when taken in conjunction with the accompanying drawings, wherein.

DETAILED DESCRIPTION

Figure 1:
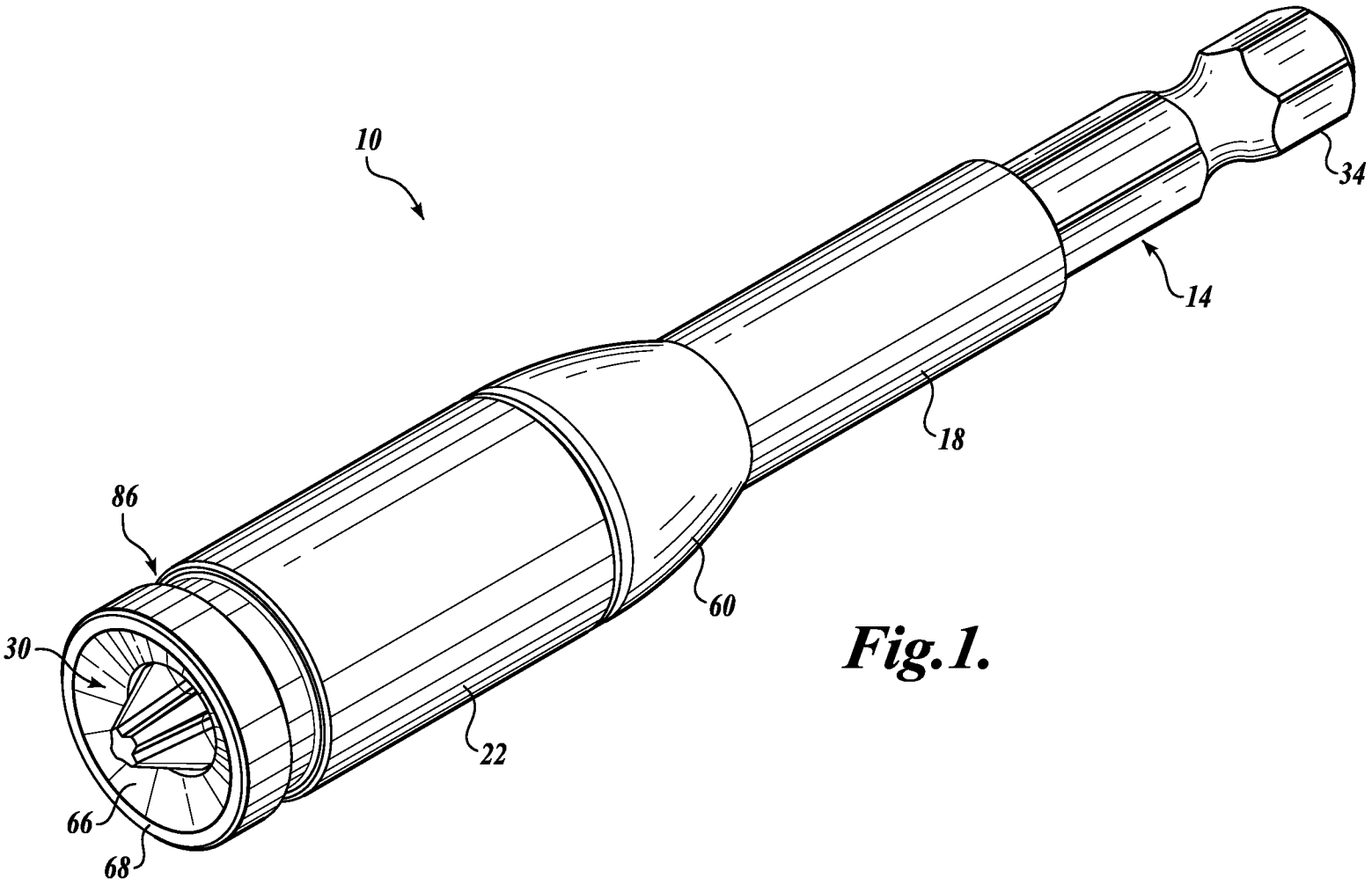
FIG. 1 is an isometric view of a depth setter bit holder formed in accordance with a preferred embodiment of the present disclosure.

A depth setter bit holder 10 formed in accordance with a preferred embodiment of the present disclosure may best be seen by referring to FIG. 1. The depth setter bit holder 10 generally includes a tool attachment shank 14 received within a first end of a main bit holder body 18 and a drive bit 30 received within an opposite end of the main bit holder body 18. A depth setter body 22 is releasably secured to the main bit holder body 18 and houses a portion of the drive bit 30 to control the depth of a fastener being driven into a drywall substrate or similar substrate by the drive bit 30.

For ease of illustration and clarity, the depth setter bit holder 10 is mostly shown in a substantially horizontal orientation, although it may be suitably used in any orientation, such as vertical. Therefore, terminology, such as "front," "rear," "forward," "rearward," etc., should be construed as merely descriptive and not limiting. Further, although certain geometric shapes may be illustrated and described below, it should be understood that such terms are intended to be merely descriptive and not limiting. Hence, other geometric shapes, such as oval, round, square, etc., are also within the scope of the present disclosure.

Figure 2:
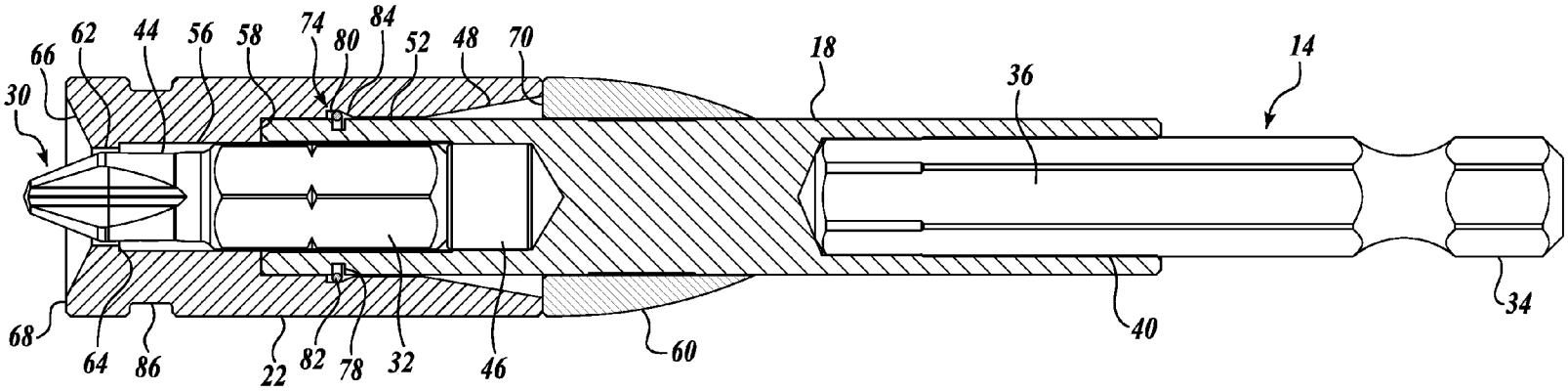
FIG. 2 is a side cross-sectional view of the depth setter bit holder of FIG. 1.

Referring to FIG. 2, the components of the depth setter bit holder 10 will now be described in detail. The tool attachment shank 14 includes a tool attachment end 34 that is suitably sized and shaped to be received and retained within a receptacle or chuck of any standard hand drill, screwdriver, or similar tool. For instance, the tool attachment end 34 may be hex shaped or any other suitable polygonal shape that is received within a correspondingly shaped chuck of a drill.

The tool attachment shank 14 includes a bit attachment end 36 defined opposite the tool attachment end 34 that is suitably sized and shaped to be received within a tool attachment receptacle 40 of the main bit holder body 18. The main bit holder body 18 may be press fit around the bit attachment end 36 of the tool attachment shank 14 or otherwise secured to the tool attachment shank 14 in any other suitable manner, such as by magnetic force. Moreover, it should be appreciated that the main bit holder body 18 and the tool attachment shank 14 may instead be formed integrally as a single component.

The main bit holder body 18 includes a bit receptacle 42 formed in the end of the main bit holder body 18 opposite the tool attachment receptacle 40. The bit receptacle 42 is suitably sized and shaped to removably receive the hex shank 32 of the drive bit 30 therein. The drive bit 30 may be removably secured within the bit receptacle 42 in any suitable manner. Preferably, the main bit holder body 18 and drive bit 30 are formed from suitable metals such that the drive bit 30 is magnetically retained within the bit receptacle 42 in a manner well known in the art. For instance, in the embodiment illustrated, a magnet 46 Is disposed within the bit receptacle 42. In the alternative, the main bit holder body 18 may include a ball detent or similar mechanism that selectively interferes with detents formed on the exterior surface of the hex shank 32 of the drive bit 30 to removably secure the drive bit 30 therein.

Figure 3A:
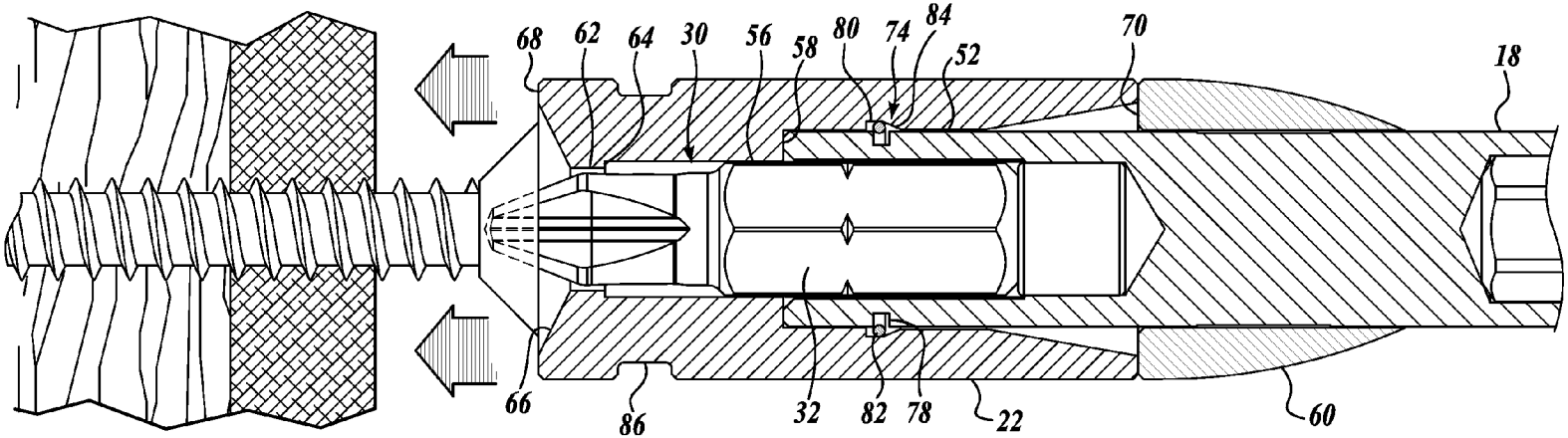
FIG. 3A is a side cross-sectional view of the depth setter bit holder of FIG. 1 shown in a first engaged position.
Figure 3B:
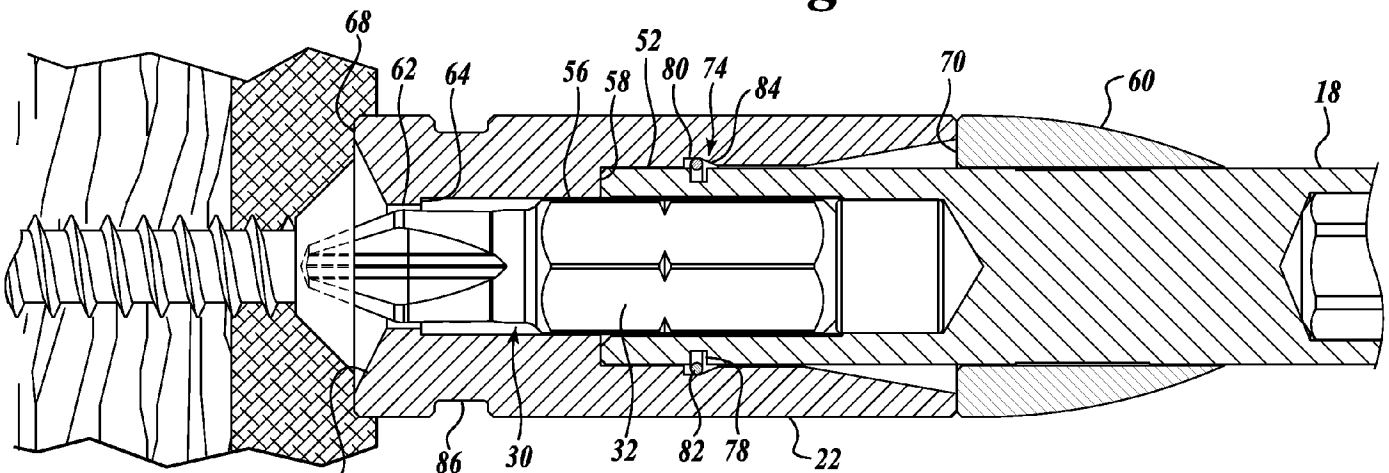
FIG. 3B is a side cross-sectional view of the depth setter bit holder of FIG. 1 shown in a second engaged position.
Figure 3C:
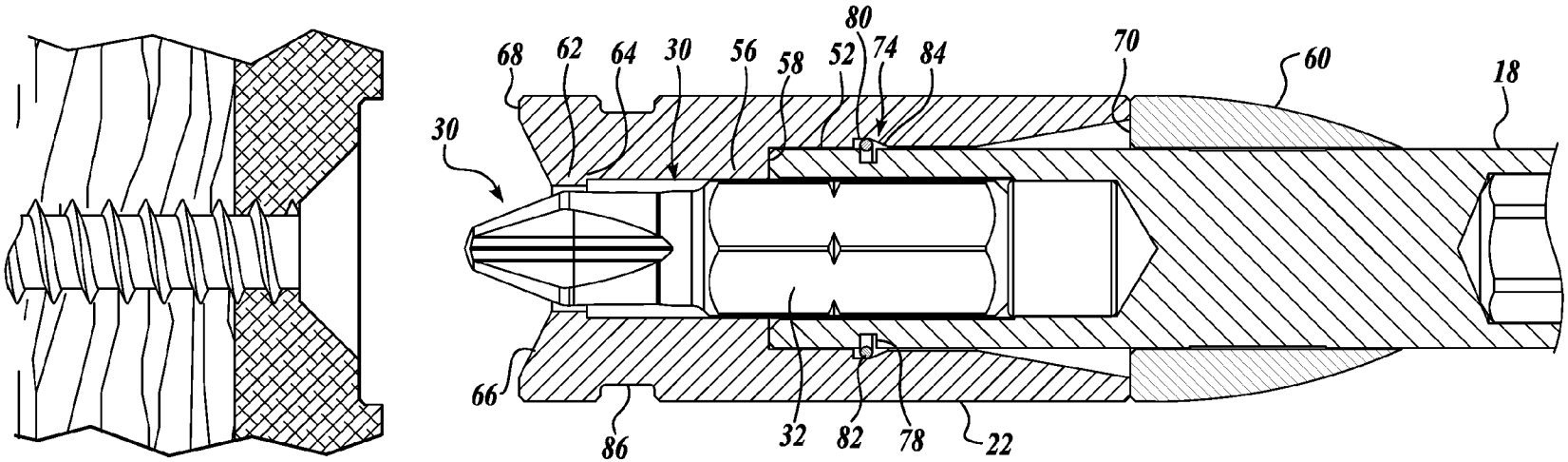
FIG. 3C is a side cross-sectional view of the depth setter bit holder of FIG. 1 shown in a third disengaged position.
Figure 4:
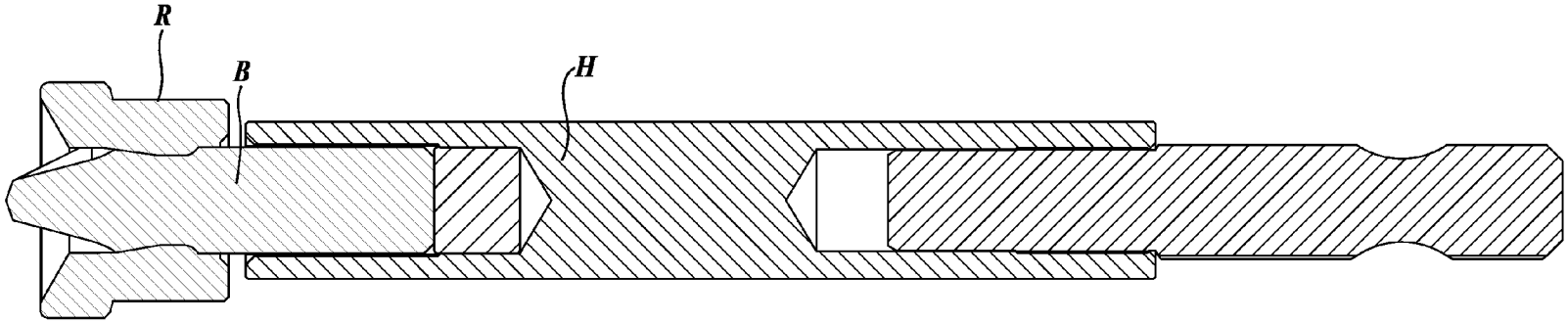
Fig. 4. (PRIOR ART)
FIG. 4 is a side cross-sectional view of a prior art depth setter bit.

The magnet 46 also helps magnetically retain a fastener, such as a screw, on the driving end of the drive bit 30 in a manner well known in the art (see FIGS. 3A-3C). The drive bit 30 is shown as a one inch Phillips drive bit since drywall screws typically include a flattened Phillips drive head. However, it should be appreciated that the bit receptacle 42 of the main bit holder body 18 may be configured to receive any suitable drive bit 30 therein, such as one inch bits, two inch bits, etc., and bits having any suitable drive head (such as Phillips, Torx, Allen, Flat Head, etc.).

As noted above, the depth setter body 22 is releasably secured to the main bit holder body 18 and houses a portion of the drive bit 30 to control the depth of a screw driven into a substrate. The depth setter body 22 is substantially cylindrical in shape and includes an internal cavity 44. The internal cavity 44 includes an overall diameter sized to slidably and rotatably receive a portion of the main bit holder body 18 therein, and the internal cavity 44 is of an overall length to house a substantial portion of the drive bit 30 protruding from the main bit holder body 18. The internal cavity 44 of the depth setter body 22 is defined by several internal bores of differing diameters, wherein the internal bores house portions of the main bit holder body 18 and drive bit 30 therein as briefly described above.

More specifically, the internal cavity 44 defines a first conically tapered surface 48 at a first end of the depth setter body 22 that is sized and configured to guide the main holder body 18 into the internal cavity 44. A main bit holder body bore 52 extends from the first conically tapered surface 48 away from the first end of the depth setter body 22. The main bit holder body bore 52 is sized and configured to securely receive the main bit holder body 18 therein. In that regard, the main bit holder body bore 52 has a diameter that is substantially the same size and the diameter of the main bit holder body 18.

However, the main bit holder body bore 52 is also sized such that there is sufficient clearance between the main bit holder body 18 and the depth setter body 22 so that the depth setter body 22 may slidably and rotatably receive the main bit holder body 18 therein. In that regard, the depth setter body 22 and main bit holder body 18 are made from suitable materials and are manufactured in a suitable manner such that there is minimal friction between the depth setter body 18 and the main bit holder body 18 when the main bit body 18 rotates relative to the depth setter body 22.

A drive bit bore 56 extends from the main bit holder body bore 52 away from the first end of the depth setter body 22. The drive bit bore 56 is sized to house a portion of the drive bit 30 extending from the main bit holder body 18. The drive bit bore 56 is of a predetermined diameter such that the drive bit 30 may rotate freely with respect to the depth setter body 22.

The drive bit bore 56 is of a reduced diameter compared to the main bit holder body bore 52 to define a first shoulder 58 between the main bit holder body bore 52 and the drive bit bore 56. The end of the main bit holder body 18 is engageable with the first shoulder 58 to limit the axial inward movement of the main bit holder body 18 within the depth setter body 22. In that regard, the main bit holder body bore 52 is of a predetermined axial length to locate the depth setter body 22 on the main bit holder body 18 in a predetermined axial position. In this manner, the drive bit 30 may protrude from the depth setter body 22 a predetermined amount so that the depth setter body 22 can control the depth of a fastener driven into a substrate by the drive bit 30.

Referring additionally to FIGS. 3A-3C, the first shoulder 58 also acts as a depth stop for the depth setter body 22 when the depth setter bit holder 10 is driving a fastener into a substrate. More specifically, the depth setter body 22 is maintained in its axial position with respect to the drive bit 30 when the depth setter body 22 engages the first shoulder 58. As such, the depth setter body 22 may control the depth of the fastener driven within the substrate.

A ramped collar 60 may additionally be provided on the exterior of the main bit holder body 18 to help limit the axial inward movement of the depth setter body 22 when driving a fastener into a substrate. The ramped collar 60 is secured to or otherwise formed on the main bit holder body 18 in any suitable manner, and it includes a substantially transverse end face 70 that is engageable with the end of the depth setter body 22. The ramped collar 60 also provides the added benefit of defining a smooth transition between the depth setter body 22 and the main bit holder body 18 when the depth setter body 22 is received on the main bit holder body 18. In this manner, the edge of the depth setter body 22 does not easily become caught on loose objects, which could cause the depth setter body 22 to become dislodged from the main bit holder 18.

A drive bit opening 62 is defined at the end of the drive bit bore 56 near the second end of the depth setter body 22. The drive bit opening 62 is of a diameter suitably sized to provide clearance between the depth setter body 22 and the driving end of the drive bit 30 such that the drive bit 30 may rotate freely with respect to the depth setter body 22. The drive bit opening 62 is also preferably smaller in diameter than the drive bit bore 56. As such, a second shoulder 64 is defined between the drive bit bore 56 and the drive bit opening 62. The shoulder of the hex shank 32 of the drive bit 30 may engage the second shoulder 64 to limit the axial movement of the drive bit 30 within the depth setter body 22. As such, if the drive bit 30 becomes dislodged from the main bit holder body 18 when driving a fastener into a substrate, the second shoulder 64 will prevent the drive bit 30 from falling out of the depth setter body 22.

A second conically tapered surface 66 extends from the drive bit opening 62 and intersects a front stop face 68 defined on the forward, second end of the depth setter body 22. The second conically tapered surface 66 provides clearance for the head of a fastener engaged with the end of the drive bit 30.

The front stop face 68 is preferably substantially transverse to the elongated axis of the depth setter body 22 such that it is engageable with the substrate surface when driving a fastener into the substrate. Moreover, the front stop face 68 is positioned axially relative to the driving end of the drive bit 30 such that the interference of the front stop face 68 with the substrate causes the drive bit 30 to disengage the fastener when it is driven into the substrate a predetermined depth, as shown in FIGS. 3A-3C, and as is well known in the art.

As noted above, the depth setter body 22 is slidably and rotatably received on the main bit holder body 18. The depth setter body 22 is also removably secured on the main bit holder body 18. In this regard, a locking mechanism 74 is defined between the depth setter body 22 and the main bit holder body 18 for selectively securing the depth setter body 22 on the main bit holder body 18. The locking mechanism 74 is defined by a first annular groove 78 formed on the exterior surface of the main bit holder body 18 and a second annular groove 80 formed within the main bit holder body bore 52 of the depth setter body 22. The first annular groove 78 substantially aligns the second annular groove 80 when the main bit holder body 18 is fully received within the depth setter body 22 as described above (i.e., the main bit bolder body 18 engages the first shoulder 58).

The locking mechanism 74 further includes a spring clip 82 partially disposed within the first annular groove 78. The spring clip 82 is preferably oval in shape or another suitable shape and size such that it is normally in a partially extended position when received within the first annular groove 78. In this manner, the spring clip 82 will also extend into the second annular groove 80 when the first and second annular grooves 78 and 80 are aligned. With the spring clip 82 disposed within the first and second annular grooves 78 and 80, the spring clip 82 retains the depth setter body 22 axially on the main bit holder 18 when the main bit holder body 18. Moreover, the extension of the spring clip 82 within the second annular groove 80 causes a snap or tactile sensation to indicate to the user that the main bit holder body 18 is fully received within the depth setter body 22.

The spring clip 82 is also compressible within the first annular groove 78 by the interior surface of the depth setter body 22. More specifically, when the main bit holder body 18 is slid within the depth setter body 22, the first conically tapered surface 48 engages the spring clip 82 to compress the spring clip 82 within the first annular groove 78. As such, the main bit holder body 18 can be slid within the depth setter body 22. The main bit holder body 18 is slid inwardly until the end of the main bit holder body 18 engages the shoulder 58, thereby aligning the first and second annular grooves 78 and 80. With the first and second annular grooves 78 and 80 aligned, the spring clip 82 may extend partially into the second annular groove 80. The interference of the spring clip 82 and the first and second annular grooves 78 and 80 retains the depth setter body 22 axially on the main bit holder body 18.

An annular ramp 84 is formed on the interior of the depth setter body 22 and extends from the second annular groove 80 toward the first end of the depth setter body 22. The annular ramp 84 urges the spring clip 82 into the first annular groove 78 when a predetermined axial force is exerted on the depth setter body 22 and/or the main bit holder body 18. The spring clip 82, as noted above, is compressed within the first annular groove 78 by the interior surface of the depth setter body 22. As such, the main bit holder body 18 may be pulled outwardly from within the depth setter body 22 (or the depth setter body 22 may be pulled off the main bit holder body 18) upon exertion of a predetermined axial pulling force. In this regard, the depth setter body 22 may include an exterior annular groove 86 or other suitable contour that defines a gripping surface for pulling axially on the depth setter body 22.

As can be appreciated from the foregoing, the locking mechanism 74 removably secures the depth setter body 22 on the main bit holder body 18. As such, the depth setter body 22 may be removed to replace the drive bit 30 within the main bit holder body 18 when, for instance, the drive bit 30 becomes worn. Replacing the drive bit 30 is much less expensive that replacing the entire depth setter bit holder 10.

Furthermore, the depth setter body 22 may be easily removed such that the main bit holder body 18 and drive bit 30 may be used as a normal driver (when received within the receptacle or chuck of the tool, such as a screwdriver or hand drill). As described in the Background section above, such use may be desired when, for example, a fastener must be driven into a corner or another constrained area that does not accommodate the enlarged diameter of the depth setter body 22.

Moreover, by using a spring clip 82 to removably secure the depth setter body 22 on the main bit holder body 18, the depth setter body 22 is still rotatable with respect to the main bit holder body 18 when secured thereon. As such, the user can hold the depth setter body 22 substantially steady when driving a fastener into a substrate. The user may grip the exterior annular groove 86 of the depth setter body 22 to maintain the steady grip when using the tool. By holding the depth setter body 22 steady, the fastener can be more easily driven straight into the substrate, as shown in FIGS. 3A-3C. Furthermore, the front stop face 68 of the depth setter body 22 causes minimal marring or destruction to the substrate since it does not have to rotate with the drive bit 30.

In addition to the benefits described above, by using the locking mechanism 74 rather than press fitting the depth setter body 22 onto the main bit holder body 18, a softer, non-magnetic material may be used for the depth setter body 22. Using a non-magnetic material increases the resultant magnetic holding power of the drive bit 30 with the head of a fastener. Likewise, the resultant magnetic holding power of the main bit holder body 18 with the drive bit 30 is increased.

It should be appreciated that although a locking mechanism defined by first and second annular grooves and a spring clip is preferred, other suitable locking mechanisms are also within the scope of the present disclosure. Thus, while illustrative embodiments have been illustrated and described, it will be appreciated that various changes can be made therein without departing from the spirit and scope of the present disclosure.

The embodiments of the present disclosure in which an exclusive property or privilege is claimed are defined as follows:

1. A depth setter bit holder comprising:

(a) a main bit holder body having first and second ends and a first receptacle defined at the first end of the main bit holder body;

(b) a drive bit removably receivable within the first receptacle of the main bit holder body;

(c) a depth setter body removably securable on the first end of the main bit holder body such that the depth setter body partially encloses the drive bit and the depth setter body wherein a portion of the depth setter body is engageable with the main bit holder in a locked position to substantially prevent movement of the depth setter body in a first axial direction toward the second end of the main bit holder body when the depth setter body is in the locked position; and (d) a ramped collar secured on the main bit body holder, the depth setter body engageable with the ramped collar when the depth setter body is moved in the first axial direction.

2. The depth setter bit holder of claim 1, wherein the depth setter body includes an internal cavity defining a main bit holder body bore sized and configured to slidably and rotatably receive the main bit holder body.

3. The depth setter bit holder of claim 2, wherein the internal cavity defines a drive bit bore having a diameter less than a diameter of the main bit holder body bore, thereby defining a first shoulder between the main bit holder body bore and the drive bit bore that is engageable with the main bit holder body to substantially prevent movement of the depth setter body in the first axial direction toward the second end of the main bit holder body.

4. The depth setter bit holder of claim 3, further comprising a locking mechanism configured to releasably secure the depth setter body to the main bit holder body.

5. The depth setter bit holder of claim 4, wherein the locking mechanism comprises a first annular groove formed on the main bit holder body, a second annular groove formed on the depth setter body and alignable within the first annular groove, and a spring clip disposable within the first and second annular grooves.

6. The depth setter bit holder of claim 5, wherein the first and second annular grooves are aligned when the main bit holder body engages the first shoulder.

7. The depth setter bit holder of claim 5, further comprising an annular ramp extending between the second annular groove and the main bit holder body bore, wherein the annular ramp is configured to urge the spring clip into the first annular groove when the depth setter body is moved in a second axial direction relative to the main bit holder body.

8. The depth setter bit holder of claim 5, further comprising a first conically tapered surface extending from the main bit holder body bore toward an end of the depth setter body, wherein the first conically tapered surface is configured to urge the spring clip into the first annular groove when the depth setter body is moved in the first axial direction relative to the main bit holder body.

9. The depth setter bit holder of claim 2, wherein the internal cavity defines a drive bit bore having a diameter, the drive bit bore defining a drive bit opening with a diameter less than the diameter of the drive bit bore, thereby defining a second shoulder between the drive bit bore and the drive bit opening that is engageable with a portion of the drive bit.

10. The depth setter bit holder of claim 1, further comprising a tool attachment shank extending from the second end of the main bit holder body opposite the first receptacle.

11. A depth setter bit holder for use with a hand tool, comprising:

(a) a main bit holder body having first and second ends and a first receptacle defined at the first end of the main bit holder body;

(b) a drive bit removably receivable within the first receptacle of the main bit holder body;

(c) an attachment shank extending from the second end of the main bit holder body opposite the drive bit;

(d) a depth setter body removably securable on the first end of the main bit holder body such that the depth setter body partially encloses the drive bit, wherein a portion of the depth setter body is engageable with the main bit holder body when the depth setter body is moved in a first axial direction toward the second end of the main bit holder body, wherein the depth setter body is in a locked position when the depth setter body is engaged with the main bit holder body, the depth setter body moveable in a second axial direction relative to the main bit holder body toward a removed position;

(e) a ramped collar secured on the main bit body holder body, the depth setter body engageable with the ramped collar when the depth setter body is in the locked position; and (f) a locking mechanism configured to releasably secure the depth setter body to the main bit holder body in the locked position.

12. The depth setter bit holder of claim 11, wherein the depth setter body includes an internal cavity defining a main bit holder body bore sized and configured to slidably and rotatably receive the main bit holder body.

13. The depth setter bit holder of claim 12, wherein the internal cavity defines a drive bit bore having a diameter less than a diameter of the main bit holder body bore, thereby defining a first shoulder between the main bit holder body bore and the drive bit bore that is engageable with the main bit holder body.

14. The depth setter bit holder of claim 13, wherein the locking mechanism comprises a first annular groove formed on the main bit holder body, a second annular groove formed on the depth setter body and alignable within the first annular groove, and a spring clip disposable within the first and second annular grooves.

15. The depth setter bit holder of claim 14, wherein the first and second annular grooves are aligned when the main bit holder body engages the first shoulder in the locked position.

16. The depth setter bit holder of claim 14, further comprising an annular ramp extending between the second annular groove and the main bit holder body bore, wherein the annular ramp is configured to urge the spring clip into the first annular groove when the depth setter body is moved in the second axial direction relative to the main bit holder body.

17. The depth setter bit holder of claim 14, further comprising a first conically tapered surface extending from the main bit holder body bore toward an end of the depth setter body, wherein the first conically tapered surface is configured to urge the spring clip into the first annular groove when the depth setter body is moved in the first axial direction.

18. The depth setter bit holder of claim 12, wherein the internal cavity defines a drive bit bore having a diameter, the drive bit bore defining a drive bit opening with a diameter less than the diameter of the drive bit bore, thereby defining a second shoulder between the drive bit bore and the drive bit opening that is engageable with a portion of the drive bit.

19. A depth setter bit holder comprising:

(a) a main bit holder body having first and second ends and a first receptacle defined at the first end of the main bit holder body;

(b) a drive bit removably receivable within the first receptacle of the main bit holder body, the drive bit having a shank portion, a driving portion, and a shank shoulder defined between the shank portion and the driving portion; and (c) a depth setter body having an internal cavity defining a depth setter body interior surface, the internal cavity defining a main bit holder body bore of a predetermined cross-section and size to rotatably and removably receive the first end of main bit holder body therein, the internal cavity further defining a drive bit bore of a predetermined cross-section and size to allow the passage and rotation of the driving portion and the shank portion of the drive bit relative to the depth setter body, the internal cavity further defining a drive bit opening bore integrally formed on the depth setter body interior surface having a drive bit opening of a fixed diameter less than a diameter of the drive bit bore to define a bore shoulder integrally formed on the depth setter body interior surface between the drive bit bore and the drive bit opening bore, wherein the drive bit opening is larger in diameter than the driving portion of the drive bit to define a gap between the drive bit opening and the driving portion of the drive bit, and wherein the drive bit opening is smaller in diameter than the shank portion of the drive bit such that the shank shoulder of the drive bit is engageable with the bore shoulder to retain the drive bit within the depth setter body.

20. The depth setter bit holder of claim 19, further comprising a ramped collar secured on the main bit body holder, the depth setter body engageable with the ramped collar when the depth setter body is moved in a first axial direction.

* * * * *